US012060220B2

(12) United States Patent
Nordqvist et al.

(10) Patent No.: US 12,060,220 B2
(45) Date of Patent: Aug. 13, 2024

(54) CAPSULE FOR PREPARING A BEVERAGE SUCH AS COFFEE AND THE LIKE

(71) Applicant: Société des Produits Nestlé S.A., Vevey (CH)

(72) Inventors: David Nordqvist, Lausanne (CH); Daniel Abegglen, Rances (CH); Arnaud Gerbaulet, Oye et Pallet (FR); Stéphane Pellegrini, Montperreux (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/559,256

(22) Filed: Dec. 22, 2021

(65) Prior Publication Data

US 2022/0112025 A1 Apr. 14, 2022

Related U.S. Application Data

(60) Continuation of application No. 16/739,541, filed on Jan. 10, 2020, now Pat. No. 11,242,195, which is a division of application No. 14/901,912, filed as application No. PCT/EP2014/063479 on Jun. 26, 2014, now abandoned.

(30) Foreign Application Priority Data

Jul. 1, 2013 (EP) ..... 13174466

(51) Int. Cl.
*B65D 65/46* (2006.01)
*B65D 85/804* (2006.01)

(52) U.S. Cl.
CPC ..... *B65D 85/8058* (2020.05); *B65D 65/466* (2013.01); *B65D 85/8043* (2013.01)

(58) Field of Classification Search
CPC ..... B65D 85/8043; B65D 85/804; B65D 85/8046; B65D 85/8058; B65D 65/466
See application file for complete search history.

(56) References Cited

U.S. PATENT DOCUMENTS

| | | | |
|---|---|---|---|
| 6,025,000 | A | 2/2000 | Fond et al. |
| 2001/0019055 | A1 | 9/2001 | Gaster |
| 2002/0048621 | A1 | 4/2002 | Boyd et al. |
| 2007/0210091 | A1 | 9/2007 | Mazzarolo |
| 2007/0267374 | A1 | 11/2007 | Middleton et al. |

(Continued)

FOREIGN PATENT DOCUMENTS

| | | |
|---|---|---|
| CN | 101888801 | 11/2010 |
| CN | 101992907 | 3/2011 |

(Continued)

OTHER PUBLICATIONS

International Search Report, mailed Jan. 20, 2015, in PCT/EP2014/072195, filed Oct. 16, 2014.

(Continued)

*Primary Examiner* — Ericson M Lachica
(74) *Attorney, Agent, or Firm* — K&L Gates LLP

(57) ABSTRACT

A capsule for the preparation of a beverage in a beverage preparation device having a flange partially made of paper and partially made of polymer so as to improve the inside tightness of the capsule, such as to prevent air enters inside the capsule via folds and creases, is disclosed. Methods of producing and using the capsule are also disclosed.

17 Claims, 5 Drawing Sheets

(56) References Cited

U.S. PATENT DOCUMENTS

| | | | | |
|---|---|---|---|---|
| 2007/0272688 | A1 | 11/2007 | Longo et al. | |
| 2009/0181136 | A1 | 7/2009 | Vesanto et al. | |
| 2010/0015307 | A1 | 1/2010 | Abegglen et al. | |
| 2010/0308064 | A1 | 12/2010 | O'Hagan et al. | |
| 2011/0185911 | A1 | 8/2011 | Rapparini | |
| 2011/0247975 | A1 | 10/2011 | Rapparini | |
| 2011/0274794 | A1 | 11/2011 | Gerbaulet et al. | |
| 2011/0278762 | A1 | 11/2011 | Middleton et al. | |
| 2011/0303095 | A1 | 12/2011 | Fu et al. | |
| 2012/0058226 | A1 | 3/2012 | Winkler et al. | |
| 2012/0135171 | A1 | 5/2012 | Swenson | |
| 2012/0251694 | A1 | 10/2012 | Kamerbeek et al. | |
| 2012/0279973 | A1 | 11/2012 | Capitani | |
| 2012/0308691 | A1 | 12/2012 | Alverez et al. | |
| 2013/0146608 | A1 | 6/2013 | Karhu et al. | |
| 2013/0224341 | A1 | 8/2013 | BenDavid | |
| 2013/0260106 | A1 | 10/2013 | Bohrer | |
| 2014/0083873 | A1* | 3/2014 | Capitani ..... | B65D 85/8061 206/0.5 |

FOREIGN PATENT DOCUMENTS

| | | |
|---|---|---|
| CN | 101784463 | 8/2012 |
| EP | 0453573 | 11/1990 |
| EP | 0512468 | 11/1992 |
| EP | 0524464 | 1/1993 |
| EP | 2151313 | 2/2010 |
| EP | 2573008 | 9/2011 |
| EP | 2573008 | 3/2013 |
| ES | 1077395 | 7/2012 |
| GB | 1095216 | 1/1965 |
| WO | 2011095518 | 8/2011 |
| WO | 2012079959 | 6/2012 |
| WO | 2012118367 | 9/2012 |

OTHER PUBLICATIONS

Written Opinion of the International Searching Authority, mailed Jan. 20, 2015, in PCT/EP2014/072195, filed Oct. 16, 2014.

U.S. Appl. No. 15/028,881, Arnaud Gerbaulet, filed Apr. 12, 2016; Office Action dated Nov. 13, 2017.

CN201480057915.4; Nestec S.A.; Office Action dated May 2, 2017; 5 pages.

CN201480057915.4; Nestec S.A.; Office Action English Translation Reporting Letter; dated May 15, 2017; 1 page.

CN201480057915.4; Nestec S.A.; Search Report; 1 page.

International Search Report, mailed Oct. 6, 2014, in PCT/EP2014/063479, filed Jun. 26, 2014.

Written Opinion of the International Searching Authority, mailed Oct. 6, 2014, in PCT/EP2014/063479, filed Jun. 26, 2014.

* cited by examiner

CAPSULE FOR PREPARING A BEVERAGE SUCH AS COFFEE AND THE LIKE

CROSS REFERENCE TO RELATED APPLICATIONS

This application is a continuation of U.S. patent application Ser. No. 16/739,541 filed Jan. 10, 2020, which is a divisional of U.S. patent application Ser. No. 14/901,912 filed Dec. 29, 2015, which is a U.S. national stage application under 35 USC § 371 of International Appl. No. PCT/EP2014/063479 filed Jun. 26, 2014, which claims priority to European Appl. No. EP 13174466.6 filed Jul. 1, 2013. The entire contents of the above-referenced applications are hereby expressly incorporated herein by reference.

BACKGROUND

The presently disclosed and/or claimed inventive concept(s) relates to a capsule for use in a beverage preparation device, such as a coffee machine and the like, to prepare a beverage such as coffee. In certain non-limiting embodiments, the presently disclosed and/or claimed inventive concept(s) more particularly relates to a capsule comprising paper materials without detriment to the storage quality of the beverage ingredients in the capsule and the functional attributes of the capsule in the device. The capsule of the presently disclosed and/or claimed inventive concept(s) is more particularly focused to protect beverage ingredients which are sensitive to oxidation such as roast and ground coffee.

Containers made of paper laminate are known. A beverage capsule for preparing a beverage in a coffee machine formed of paper-based material is also known. A paper-based capsule provides a potentially reduced environmental impact compared to capsule made of plastic materials.

EP0524464 relates to a closed or open flexible capsule which can comprise a multi-layer of aluminium/paper/plastic in combination with a rigidifying element.

WO2009050540 relates to a capsule for the preparation of a beverage such as coffee constituted of biodegradable material in particular, a composition comprising starch, fibres, proteins, lipids and at least one biodegradable resin.

EP2218653 relates to a package with a fibrous layer fixed in a wall of the shell and a closure membrane connected to the shell by material engagement. A marking can be arranged at or in the package or fixedly arranged with the shell or the closure membrane where the shell, the fibrous layer and the closure membrane are made of biologically degradable material. The closure membrane include a laminate which is jointed to two metalized bio-plastic films in an air free-manner.

WO2009/053811 relates to a container arranged for containing a dosed quantity of a solid product for extracting a beverage; the container having walls made of a material that is impermeable to water and oxygen and may be degradable and/or an edible film.

WO2010137956 relates to a capsule for containing beverage ingredients, comprising a sealing member for achieving a sealing effect with a beverage production device wherein an external surface of the sealing member comprises fibrous and/or paper-like material to achieve the sealing effect against sealing surfaces of the device during closure.

WO2010137957 relates to a capsule with a body and a flange comprising a wall including material which upon being wetted expands.

EP2573008 relates to a capsule with a paper body and cover or sealing film; the peripheral rim has a greater rigidity than the tray-like body and can be formed as a ring.

It is so advantageous to utilize paper or similar biodegradable materials as packaging material for a single-use capsule for preparing a beverage in a beverage production device. A problem is due to the properties of the formed sheet of material, either by stamping or folding, which do not allow forming a sufficiently smooth surface of the flange once formed. In particular, folds or creases appear on the flange. These folds or creases do not allow a tight sealing of the capsule, in particular, between the flange of the capsule and the cover which seals thereon. When the sealing is not perfect, rapid oxidation of certain beverage ingredients (e.g., roast and ground coffee) may occur and the quality of the beverage is adversely affected.

Furthermore, the paper-based surface is too irregular on surface to receive a readable identification marking such as an optical barcode or equivalent such as described in WO 2011/141532.

Additionally, the paper-based surface is usually insufficiently rigid for setting a pressure with a pressurizing ring-shaped counterpart of the device to control the coffee extraction, such as described in WO 2010066705.

Therefore, there is a need for inventing a paper containing capsule offering enough mechanical properties to be used in a beverage preparation device but provides a perfect sealing with the cover so that a reduced risk of oxidation is encountered.

DETAILED DESCRIPTION

Figure 1:
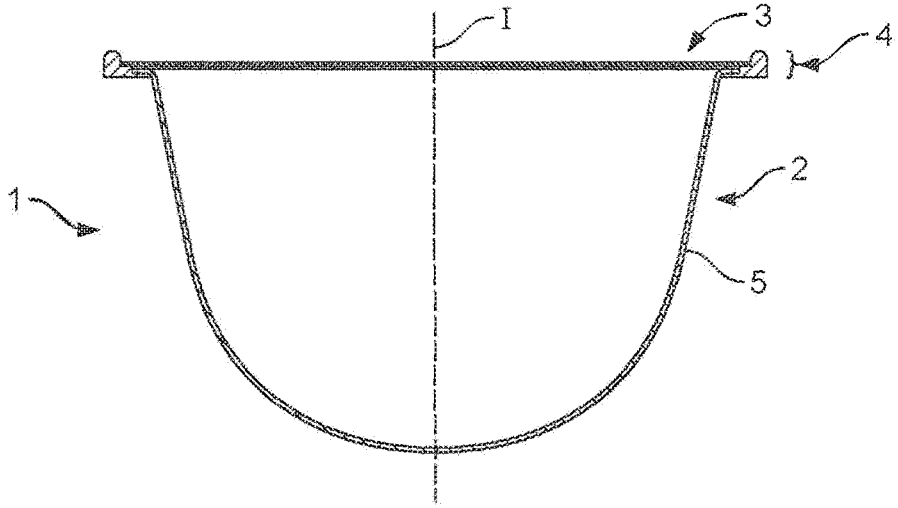
FIG. 1 shows a schematic view of a capsule according to the presently disclosed and/or claimed inventive concept(s).
Figure 2:
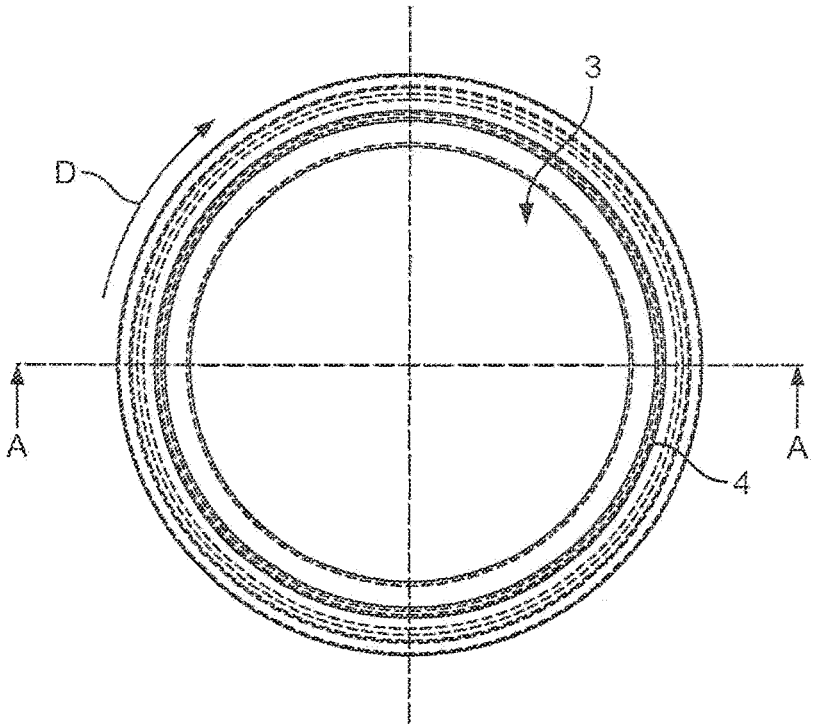
FIG. 2 shows a schematic view of the top of the capsule of FIG. 1.
Figure 3:
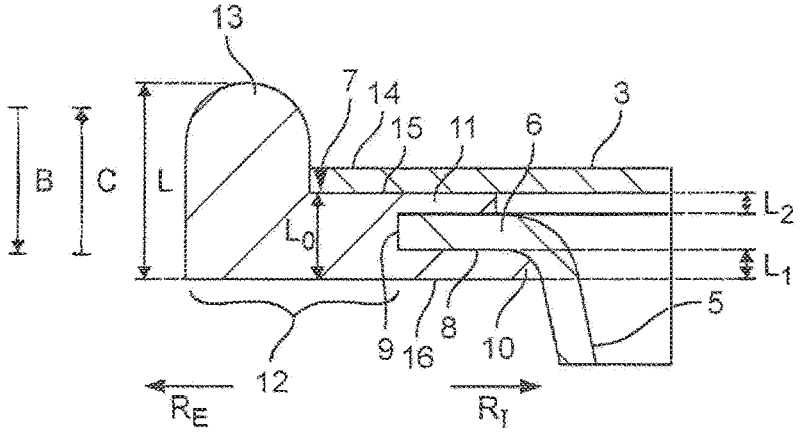
FIG. 3 shows a schematic enlarged view of the flange area of the capsule according to a first embodiment of the presently disclosed and/or claimed inventive concept(s).

The solution to the above-mentioned objects is achieved with a capsule as described in the independent claim of the presently disclosed and/or claimed inventive concept(s). The dependent claims develop further characteristics and advantages of the presently disclosed and/or claimed inventive concept(s).

In a general manner, the presently disclosed and/or claimed inventive concept(s) relates to a capsule made in part of paper material for the preparation of a beverage in a beverage preparation device. The capsule has a flange which is partially made of paper and partially made of polymer. The polymer is essentially arranged on the flange to cover at least partially the paper part and so to improve the inside tightness of the capsule, in particular, to prevent air enters inside the capsule via folds and creases.

More particularly, the presently disclosed and/or claimed inventive concept(s) relates to a capsule for the preparation of a beverage in a beverage preparation device comprising a cup-like body, a cover for closing the cup-like body; a flange for the cover to seal thereon; the cup-like body being shaped from a paper-based sheet to form a cavity wall containing beverage ingredients and an inner portion of the flange extending outwardly from the cavity wall; wherein the flange further comprises an outer flange portion formed of moulded polymer-based material comprising at least an loop-shaped recess enabling the inner flange portion to be received in and the polymer-based material of the outer flange portion to seal at least partially against a lower surface of the inner flange portion oriented in the direction B towards the cavity wall and against the outer edge of the inner flange portion.

Generally, the polymer-based material provides a proper mechanical support in the beverage preparation device enabling the capsule to offer a proper response to a force applied thereon by the device. However, the improvement comes in that such configuration of a portion of moulded polymer-based material which seals against the paper-based flange portion, in particular, the outer edge of the flange portion, ensures that the folds and creases present at any of the surfaces and in the thickness of the paper-based flange portion are properly closed thereby limiting the risk of gas leakage.

In particular, non-limiting embodiments, the cup-like shape body may form a revolutionary symmetric cavity wall, and the recess may be annular. For instance, the cavity wall is dome-shaped, trunk-shaped or cylindrical or a combination thereof. Therefore, the capsule can be designed for use in a centrifugal beverage (such as, but not limited to, coffee) preparation device such as described in WO 2010066705.

In certain non-limiting embodiments, the outer portion of flange prolongs the (paper-based) inner flange portion both in outward radial direction and in axial direction. The extension in both directions of the dimensions of the flange by the polymer-based portion contributes to providing a more effective sealing effect. It also confers an increased rigidity to the flange that compensates for the lack of rigidity of the paper-based flange.

In another aspect, the region of the (polymer-based) outer flange portion extending outwardly (or radially) beyond the inner flange portion is thicker than the lower part of the polymer-based outer flange portion sealing against the lower surface of the (paper-based) inner flange portion. Again, this configuration of thicker portion of the polymer-based material contributes to a more effective clogging of the folds and creases present in the formed paper-based material. It also promotes a higher rigidity on the outermost region of the flange which, in certain non-limiting embodiments, is required for the mechanical properties of the capsule fitting in the device.

In particular non-limiting embodiments, the outer flange portion comprises a relief of longest axial dimension compared to the axial dimension of the rest of the flange and protruding in the axial direction opposite to the direction of extension of the (paper-based) cup-like body.

Such arrangement can provide a force setting structure enabling the capsule to be inserted in a beverage preparation device comprising a ring-type pressure member to form in combination with the capsule, a beverage flow control valve. As a matter of example, such a beverage device is described in WO 2010066705. In the presently disclosed and/or claimed inventive concept(s), the structure of the capsule is optimized so that its force bearing structure is obtained with the appropriate polymer-based material, resisting crushing and offering a sufficient rigidity, while the rest of the capsule is formed of a more flexible material, i.e., paper-based material, chosen for its light weight, potentially reduced impact on environment compared to a full plastic solution and more natural feel and touch of the material.

In a first mode, the outer flange portion further extends inwardly by an upper part which seals against the upper surface of the inner flange portion. In this possible configuration, the paper-based portion of flange is covered on the three sides (bottom/top/edge) thereby ensuring a more complete filling of the folds and creases and providing consequently an improved leak-resistant capsule.

In this first mode, the cover is, in certain non-limiting embodiments, sealed against an annular top surface of the said upper part. The cover may not necessarily be sealed to the whole upper surface of the flange but at least along a sufficiently large annular portion of said upper part. The upper part which is made of moulded-polymer based material can be given a suitable surface flatness to provide a perfect adhesion of the cover over the entire circumference of the flange. For this, the cover also extends, in certain non-limiting embodiments, radially beyond the (paper-based) inner flange portion. Also, the polymer offers a compatible adhesive surface with the cover which can be coated or formed of a same or compatible polymer. Therefore, a strong bond between the cover and flange can be obtained which so confers to the capsule a high resistance to the delamination under the usually high pressure and temperature conditions of extraction in the device.

Nevertheless, it may be desirable in certain non-limiting embodiments to maintain the upper part as (axially) thin as possible since the polymer-base material (a polyolefin such as polypropylene) is usually not a suitable barrier to oxygen. In certain non-limiting embodiments, the upper part of the outer portion of flange has a thickness of less than 1 mm, such as (but not limited to) between 0.05 and 0.5 mm, or between 0.05 and 0.3 mm.

In other modes, the outer portion of flange forms a step-like recess which is arranged in open fashion extending upwardly towards the cover. The total thickness of the flange can be reduced.

In a possible mode, the cover is sealed onto the inner flange portion only. Thus, the cover fits in the annular recess formed by the polymer-based material. The advantage is twofold. Firstly, the cover can be sealed directly onto the paper-based flange thereby creating a gas barrier seal, if necessary, at the sealing junction. Secondly, the potential folds or irregularities present at the terminal edge of the cover can be closed by the polymer-based material to further improve the tightness against gas transfer of the finished capsule.

In another mode, the cover is sealed onto the upper surface forming a step-like portion of the (polymer-based) outer flange portion oriented towards the cover. For this, the cover has a sufficient diameter such that it extends beyond the paper-based inner flange portion.

In still another mode, the cover is sealed both onto the (paper-based) inner flange portion and (polymer-based)

outer flange portion. In this case, the inner flange portion may be (but is not limited to) a paper-based laminate comprising an upper sealing layer made of material sealable and the cover comprises a lower sealable layer compatible with the sealable material of the sealable layer of the upper sealing layer. An advantage of this configuration is that a more secured sealing can be achieved to both suitably clog the potential folds/creases of the cover and further seal on a flat solid sealing surface offered by the polymer material.

In the context of the presently disclosed and/or claimed inventive concept(s), the term "paper" refers to paper, cardboard, pulp of cellulose or equivalent natural fibres. The terms "paper-based material", "paper-based layer" and the like refer to a material, layer and the like containing at least 50% in weight of paper. The terms "paper-containing material", "paper-containing layer" and the like refer to a material, layer and the like with no minimal limit in volume but in certain non-limiting embodiments may be less than 50% in weight. The paper-based and paper-containing sheets can be obtained by different technologies such as lamination and/or forming and can be combined with layers of other functional materials.

In certain non-limiting embodiments, the paper-based sheet may be a laminate of paper and thermo-formable polymer layer(s).

The paper-based sheet of the body comprises at least one oxygen barrier layer such as EVOH, AlOx, SiOX, metal, metalized film or a combination thereof. In certain non-limiting embodiments, the barrier layer has a thickness comprised between 5-20 μm, such as between 8-15 μm. A metalized film can be for instance a PET layer coated with thin (e.g. 1 μm) metal layer.

In certain non-limiting embodiments, the paper-based sheet of the body also comprises at least one thermo-formable polymer layer oriented towards the cavity. In certain non-limiting embodiments, the paper-based sheet comprises a multi-layer of polyolefin(s), such as (but not limited to) PP or PE or combinations thereof. Such thermo-formable polymer layer(s) confers the defined, self-sustainable cup-like shape to the body after forming. The paper-based layer can be deformed to the desired capsule shape under heat and pressure using a press. The formable polymer layer may further provide a sealing function with the cover when necessary.

In an exemplary mode, the paper-based sheet for the cup-like body comprises (from inside to outside): one or a plurality of polyolefin(s), such as (but not limited to) PP or PE or combinations thereof, of a thickness between 30-100 μm including and at least one gas barrier layer (e.g., 5-15 μm of EVOH)/paper between 50-400 μm, such as (but not limited to) 200-350 μm. Optionally, one or a plurality of additional thermo-formable polymer layer(s) of polyolefin, such as PP or PE, of thickness between 10-50 μm, is provided on the outer surface of the cup-like shaped body. The different polymer layers are usually bound by tie layers of a few micrometers.

In general, the paper layer of the sheet may have a density comprised between 100 and 400 g/m$^2$.

In certain non-limiting embodiments, the cover is a paper-containing sheet. The cover may be flat, i.e., non-formed in a three-dimensional shape. In particular non-limiting embodiments, the cover comprises a gas barrier layer such as EVOH, AlOx, SiOX, metal, metalized film or a combination thereof.

In certain non-limiting embodiments, the cover comprises a sealing layer oriented towards the cavity or the bottom of the body. The sealing layer may be a polyolefin, such as (but not limited to) polypropylene or polyethylene, on the inner side suitable for sealing with the flange of the capsule. A particular, non-limiting example of laminate for the cover is (from outside to inside): paper/gas barrier/polyolefin. The laminate may be about 100-200 μm thick; paper of 50-150 μm/EVOH or similar gas barrier of 5-40 μm/polypropylene of 20-50 μm.

In general, the paper layer of the cover may have a density comprised between 15 and 150 g/m$^2$, such as (but not limited to) between 20 and 80 g/m$^2$. In certain non-limiting embodiments, the density may be chosen to promote the sealing of the cover and have a sufficiently fast sealing.

In certain non-limiting embodiments, the barrier to oxygen for both the cover and the body is selected to provide a sufficient shelf life depending on the nature of the beverage ingredients. For coffee, for example, the shelf life expected may be of 12 months.

The polymer-based material for the outer flange is overmoulded by injection-moulding on the inner portion of flange. Therefore, in certain non-limiting embodiments, it is an injection-mouldable thermoplastic material or elastomeric-thermoplastic material (TPE).

The polymer-based material can be selected from a group comprising: polyethylene (PE), high-density polyethylene (HDPE), polypropylene or polyethylene terephthalate (PET) and combinations thereof.

In a possible aspect, the moulded polymer-based material comprises reinforcing material, i.e., fillers such as fibres. The fibers can be glass fibers. In particular, the reinforcing material increases the mechanical properties of the flange and enables the flange to deform less under the internal pressure present in the capsule. As a result, the risk of delamination of the sealing with the cover is reduced.

In certain non-limiting embodiments, the outer portion of flange may further comprise an identification code such as an optically readable code. In certain non-limiting embodiments, the code may be applied on the lower surface of the outer flange portion. The identification code can be formed by the surface of the outer flange portion being textured or printed on the outer surface. The identification code can be formed by a series light-reflective surface portions and light-absorbing surface portions wherein the light-absorbing surface portions have a higher rugosity (Rz) than the light-reflective surface portions such as described in WO 2013/072326. For example, the light-reflective surface portions are non-roughened or mirror-reflective surfaces of the base layer or structure itself. The light-absorbing surfaces are formed in the flange by any one of: sand blasting, shot blasting, milling, chemical attack, laser engraving, in-mould forming, depositing and combinations thereof. The identification code can also be formed by a series of small surfaces portions providing different light reflection angles such as described in WO 2011/141532.

In certain non-limiting embodiments, the beverage ingredients are chosen amongst ground coffee, soluble coffee, coffee beans, leaf tea, soluble tea, dairy product, cocoa, chicory, barley, culinary aid, soup ingredient, infant formula and combinations thereof.

In particular non-limiting embodiments, the beverage ingredients are roast and ground coffee. For example (but not by way of limitation), it may contain a weight of roast and ground coffee comprised between 4 and 20 grams, such as (but not limited to) between 5 and 15 grams. Depending on the weight of roast and ground coffee, can be prepared a liquid coffee extract of a risttreto cup of about 25 grams, espresso cup of about 40 grams, lungo cup of about 110 grams or long coffee of about 230 grams or higher. In general, roast and ground coffee may be selected to have a volumetric mean of particle diameter (D4,3) comprised, in certain non-limiting embodiments, between 190 and 750 μm (as determined by the method described on page 12, "5. Granulometry" of WO2008/012202).

The capsule of the presently disclosed and/or claimed inventive concept(s) may typically interact with the beverage and/or food preparation device such as by being fed with a diluent (e.g. hot, cold or ambient water) in the container; such diluent mixing, or interacting otherwise with the beverage ingredients.

In certain non-limiting embodiments, the cavity delimited by the body and cover of the capsule is essentially oxygen-free and the empty space is saturated with an inert gas such as nitrogen, carbon oxide and combinations thereof. In certain non-limiting embodiments, the capsule has an internal pressure of gas above atmospheric pressure due to the gas contained in the coffee and emanating in the cavity after sealing such as carbon oxide and dioxide. The presently disclosed and/or claimed inventive concept(s) further relates to the use of a capsule as described in the presently disclosed and/or claimed inventive concept(s) in a beverage preparation device.

In certain non-limiting embodiments, the beverage preparation device is—may be a centrifugal beverage preparation device comprising a capsule holder for receiving the capsule, a liquid supply member and an interface member comprising a peripheral engaging portion for engaging against the flange of the capsule.

The capsule 1 illustrated in FIGS. 1 to 4 is designed for preparing a beverage in a beverage preparation device such as a dedicated coffee machine. The capsule comprises a cup-like body 2, a cover 3 for closing the cup-like body and a flange 4. The cover 3 is typically sealed on the flange 4.

The cup-like body forms a revolutionary-symmetric cavity wall 5 defining an internal cavity. In particular, the wall is formed symmetrically relative to a central axis I of the capsule. The wall may take a convex shape such as illustrated or other various shapes such as trunconical, cylindrical or combinations thereof. The body of the presently disclosed and/or claimed inventive concept(s) may be designed with relatively wide ranges of depth-to-diameter ratios; for instance, comprised between 0.2:1 to 2:1. In this context, the diameter is considered as the maximal diameter of the cavity and the depth is considered as the maximal internal depth of the cavity. Typically, for a given shape, the higher the depth-to-diameter ratios, the higher the risk of pleats in the paper-based material forming the body. Certain shapes with short radiuses and/or corners are also more prone to form pleats.

The capsule contains a predetermined dose of beverage ingredients; such as roast and ground coffee suitable for preparing a liquid coffee extract upon injection of hot water in the capsule.

First of all, the flange 4 comprises an inner portion of the flange 6 extending outwardly from the cavity wall 5. Secondly, the flange 4 comprises a second portion of flange; in particular, an outer flange portion 7 which is formed of polymer-based material. The polymer-based material is a thermo-mouldable material.

This polymer-based outer flange portion 7 is shaped to form an annular recess 8 oriented in inward radial direction RI, towards the central axis of the capsule. The annular recess is thereby configured to receive the paper-based flange portion 6 and to cover it essentially along three sides. The outer flange portion thus partially seals against the inner flange portion. More particularly, the outer flange portion covers the terminal edge 9 of the inner portion 6. Furthermore, the outer flange portion also extends below the inner flange portion 6 by a lower part 10 and above the inner flange portion 6 by an upper part 11. As a result, the pleats or creases of the paper-based material of the inner flange portion are essentially filled or covered by the polymer-based material over-moulded thereon. The In a particular non-limiting embodiment, the lower part 10 desirably (but not necessarily) extends up to the cavity wall 5.

In certain non-limiting embodiments, the paper-based sheet formed as a three-dimensional body has an outer layer made of a material which is intimately compatible in sealing with the polymer-based material. In certain non-limiting embodiments, the material of the outer layer of the sheet is a polyolefin such as PP or PE or a combination or mixture of polyolefins such as PP and PE.

In the present context, the terms "below" and "lower" or "downwards" refer to an axial direction B towards the bottom of the body. The terms "above" and "upper" or "upwards" refer to an axial direction C towards the cover.

The flange part 12 of the outer flange portion extending outwardly (radially) beyond the inner flange portion 6 is thicker than the lower part 10 (thickness $L_1$). The flange part of larger thickness $L_0$ provides an increased rigidity suitable for engagement with the device as will be described later. More particularly (but not by way of limitation), the region 12 of the moulded polymer-based flange may form an outermost relief 13 of longest axial dimension or thickness L compared to the axial dimension or thickness $L_0$ of the rest of the flange part 12. The outermost relief can serve to preset the opening pressure of a flow restriction means when the capsule is positioned in the device; such pressure depending on dimension L. Of course, the capsule of the presently disclosed and/or claimed inventive concept(s) may be contemplated without such relief, in particular, when the capsule is dedicated to a different beverage device.

An annular portion 14 of the cover 3 is sealed to an annular top surface 15 of the upper part 11 of the outer flange portion 7. The cover is usually welded by heat or ultrasonic sealing to the polymer-based surface. In certain non-limiting embodiments, the cover may be formed of a paper-based sheet comprising a paper layer and, on the inside in contact with surface 15, at least one sealing thermoplastic layer which is compatible in sealing with the polymer-based material of the upper part 11. For example, the cover has a bi-layer formed of the paper (outside) and polypropylene (inside).

In certain non-limiting embodiments, the cover 3 and body 5 have a gas barrier but the material of the outer flange portion (e.g., polypropylene) is usually not a suitable gas barrier. In consequence, the thickness ($L_2$) of the upper part 11 is minimized to reduce the surface which is potentially permeable to a certain extent to oxygen. The lower limit of thickness is essentially driven by the limits of the injection moulding technology to provide a suitable sealing surface 15 for sealing of the cover thereon. In certain non-limiting embodiments, the thickness ($L_2$) is lower than 0.5 mm, such as (but not limited to) comprised between 0.05 and 0.3 mm.

In certain non-limiting embodiments, the lower surface of the outer flange portion may be relatively planar both in radial outward direction RE and in circumferential direction D to receive an identification code 16 such as described in WO 2013/072326 or WO 2011/141532. The code can be an optically readable binary code which can be printed and/or embossed in the polymer material itself. A printing can be produced by applying ink or deposition of metal. Embossing can be realised by mechanical or laser engraving, chemical etching, depositing or moulding. In a particular non-limiting embodiment, the code is produced in the mass of the polymer during injection moulding of the outer flange portion onto the inner flange portion by having the negative pattern of the code embossed in the injection mould.

As a particular (but non-limiting) example, the capsule can be produced as follows:

The cup-like body is produced from a paper-based sheet by deforming it into a mould to confer the shape of the body including the inner flange pre-formed during this step. Then, the outer flange 7 is over-moulded in the same mould or after transfer to a specific injection mould. After removal (eventually, storage, stacking/destacking, transport), the capsule is filled with beverage ingredients on a product filling line and the cover is sealed onto the flange. In certain non-limiting embodiments, the filling and sealing operations may be carried out under reduced oxygen atmosphere such as under partial vacuum and/or under an atmosphere saturated in nitrogen or $CO_2$ gas.

Figure 4:
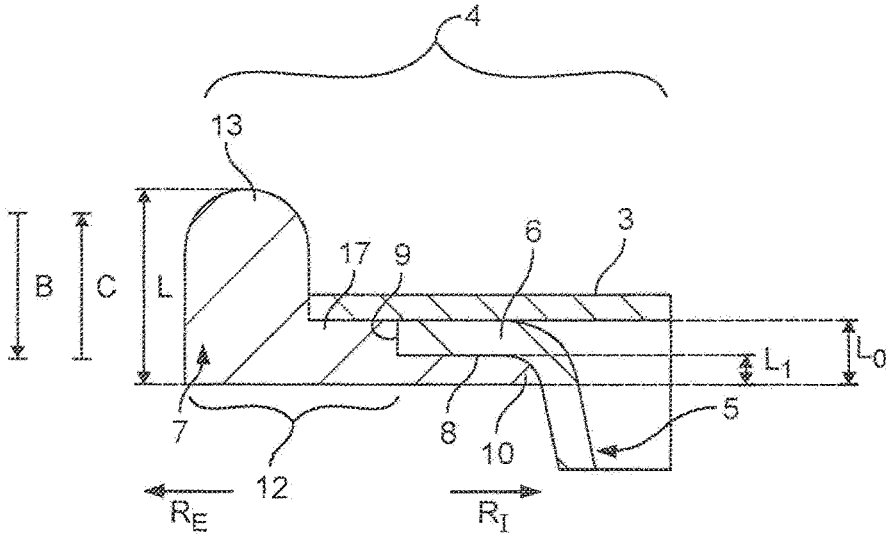
FIG. 4 shows a schematic enlarged view of the flange area of the capsule according to a second embodiment of the presently disclosed and/or claimed inventive concept(s).

Considering the second embodiment of the capsule illustrated in FIG. 4, the outer portion 7 of the flange forms a step-like recess 8 which is arranged in open manner in upward direction C and inward radial direction $R_I$. The recess forms a step-like annular recess. Therefore, the polymer-based material of the outer flange portion seals against the lower surface and against both the outer edge 9 of the paper-based inner flange portion 6. The cover 3 is sized to extend beyond the recess 8 and seals on a step-like portion 17 of the outer flange portion. The cover 3 may additionally be sealed to the upper surface of the paper-based flange portion 6. As a result, a gas tight arrangement is obtained. In this mode, the recess 8 may be sized to match the thickness of the inner flange portion 6.

Figure 5:
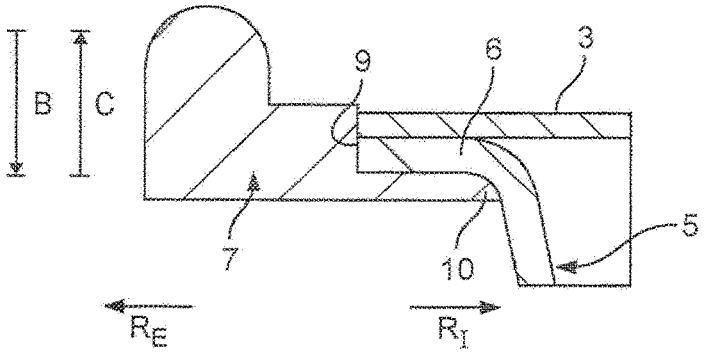
FIG. 5 shows a schematic enlarged view of the flange area of the capsule according to a third embodiment of the presently disclosed and/or claimed inventive concept(s).

In the embodiment of FIG. 5, the outer portion 7 of the flange also forms a step-like recess 8 which is arranged in open fashion and oriented in upward direction C and radial inward direction RI. The inner flange portion 6 fits in the recess in sealing engagement with the moulded outer flange portion 7. The outer flange portion covers the outer edge 9 of the inner flange portion, as well as the lower surface of the inner flange portion by a lower part 10 which can extend in inward direction R1 up to the cavity wall 5 of the body. The lower part can so join to the outer surface of the cavity wall. In this mode, the cover is only sealed to the upper surface of the inner flange portion. As a result, a gas tight arrangement is obtained. In this mode, the recess 8 may be sized to approximately match the sum of the thicknesses of the inner flange portion 6 and cover 3.

Figure 6:
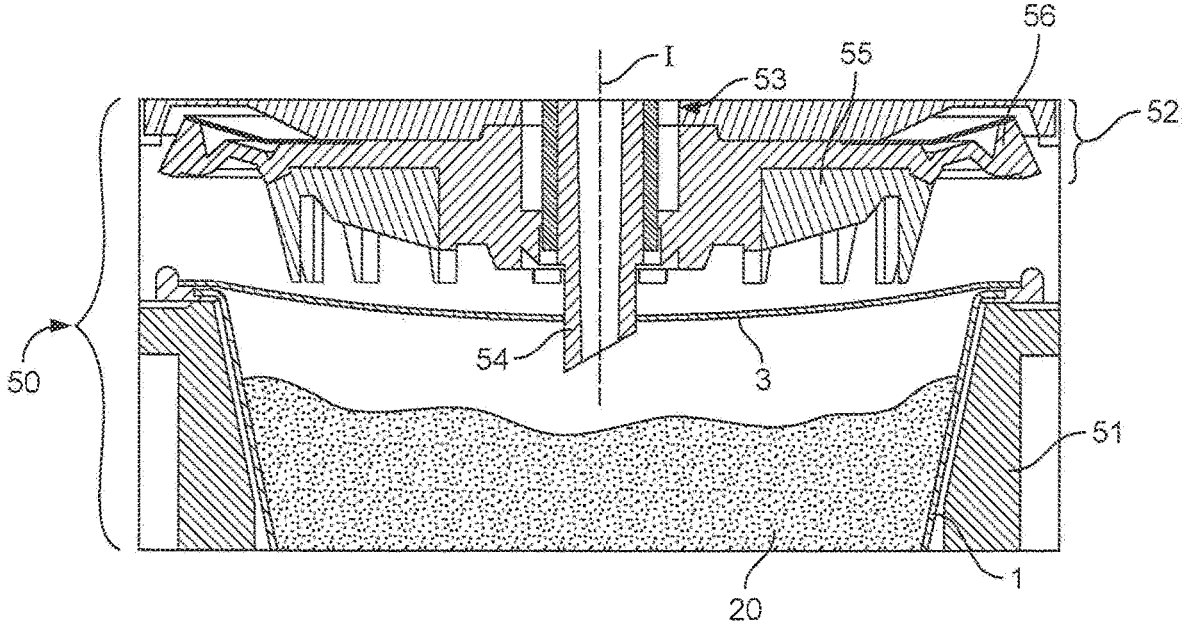
FIG. 6 shows a capsule of the presently disclosed and/or claimed inventive concept(s) in place in a beverage preparation (extaction) device before closure by an injection assembly of the device.
Figure 7:
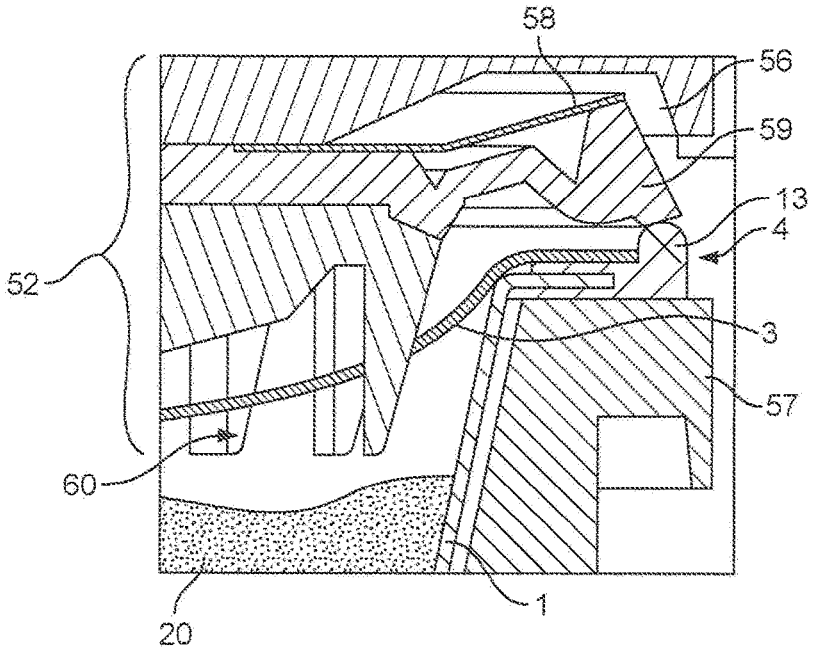
FIG. 7 shows a detail of the engagement of the capsule in the device according to the first mode.

FIGS. 6 and 7 show an example of the capsule 1 when in position in a centrifugal extraction device 50. The device typically comprises a rotating capsule holder 51 for placing the capsule in a stable position of reference in the device enabling a rotation of the capsule around its central axis I. The device further comprises a fluid interface assembly 52. The fluid interface assembly may take many various configurations. For example, it comprises a central liquid supply member 53 with a hollow needle 54 comprising a liquid conduit. The conduit is usually in communication with a liquid reservoir, a pump and a heater (not shown). The central liquid supply member 53 is mounted on a disc-shaped interface member 55. The interface member 55 comprises a peripheral engaging portion 56 which is arranged for engaging against the flange 4 of the capsule when the fluid interface assembly 52 is engaged on the capsule holder with the capsule inserted there between. The interface member 55 is also arranged to rotate around axis I. For this, the interface member is mounted in rotation relative to a frame of the device (not shown). The liquid supply member 53 may be fixed or be mounted in rotational relationship with the frame. A driving system (not shown) is provided to drive these rotating parts of the device (capsule holder, fluid interface assembly) in rotation with the capsule. The driving system usually comprises a rotary motor.

Figure 8:
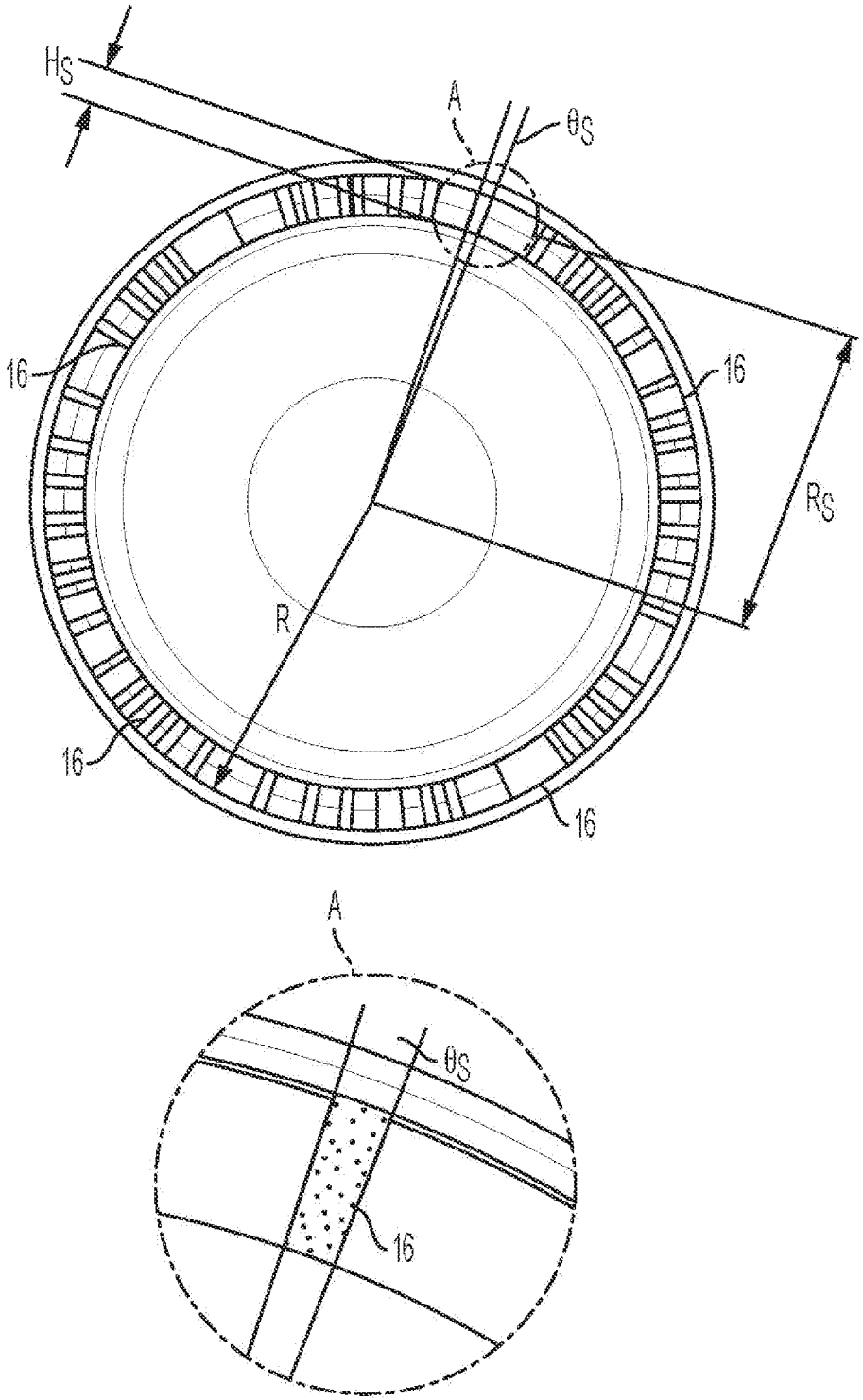
FIG. 8 illustrates an embodiment of an optically readable identification code.
Figure 9:
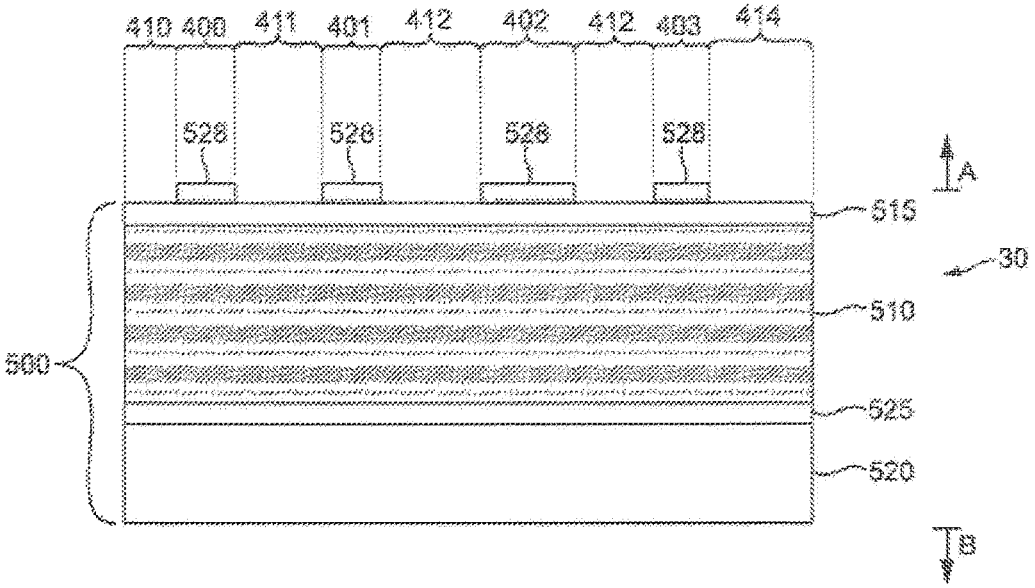
FIG. 9 is an example of an optically readable identification code.

FIG. 8 illustrates an embodiment of an optically readable identification code 16 located on a lower surface of the outer portion 7 of the flange. FIG. 9 illustrates a cross-sectional circumferential view of the optically readable identification code 16. The optically readable code comprises a readable (external) side A and a non-readable (internal) side B. At its readable side A, the support comprises successive light-reflective surfaces 400-403 and light-absorbing surfaces 410-414. The light absorbing surfaces 410-414 are formed by a base structure 500 which comprises several superimposed layers whereas the light absorbing surfaces 400-403 are formed by overlying on the base structure in local circumferential areas, discontinuous discrete portions of light absorbing material, preferably discrete portions of ink layers 528, applied onto the base structure. The base structure comprises a preferably monolithic layer of metal 510, preferably aluminum (or an alloy of aluminum) onto which is coated a transparent polymeric primer 515, preferably made of isocyanate or polyester.

The interface member 55 also comprises a series of circumferential perforating members 60. These perforating members are there to perforate beverage outlets in the cover 3. In a particular non-limiting embodiment, they are placed close to the flange where the liquid extract is centrifuged.

FIG. 6 shows the system in the closing phase, when the fluid interface assembly 52 is moved towards the capsule and the capsule is positioned inside the capsule holder. FIG. 7 shows the system in engagement of the fluid interface assembly 52 against the capsule when the capsule is positioned in the capsule holder. In such configuration, the hollow needle 54 traverses the cover 3 in such a manner that its liquid conduit communicates with the interior cavity 2 of the capsule. The needle 54 serves to perforate the cover 3.

The capsule and device form together a valve means for controlling the flow of the centrifuged beverage coming out of the capsule. More particularly, the flange 4 of the capsule rests on an annular sealing portion 57 of the capsule holder. On the fluid interface assembly 52 is provided an engaging portion 56 which engages in elastic manner with the relief 13 of the flange. The engaging portion 56 has a closing part 59 which is pre-stressed by an elastic biasing means 58 (e.g., spring). The height L of the relief of the valve determines the preset closing force of the engaging portion 56 against the flange.

The system works as follows:

An extracting liquid such as hot water is fed in the centre of the capsule by the liquid supply member (i.e., through needle 54). The capsule is filled with liquid hot which so prewets the beverage ingredients, such as ground coffee powder 20. After filling, the capsule is driven in rotation by the rotating capsule holder and fluid interface assembly. Liquid will traverse the bed of coffee powder to transform into coffee extract and will traverse the perforated outlets by effect of the centrifugal forces. Then, the flow of coffee extract exerts a pressure which forces the closing part 59 to flex against the effect of the biasing means 58. Thus, a circumferential gap is provided during centrifugation which enables the coffee extract (or any other beverage liquid brewable in a similar way) to be ejected towards a collecting means (not represented) and funneled towards a receptacle (e.g. cup).

The capsule of the presently disclosed and/or claimed inventive concept(s) may of course be used in different other beverage production devices and is not limited to the present one described as a non-limiting example for purposes of illustration only.

The invention is claimed as follows:

1. A capsule configured for preparation of a beverage in a beverage preparation device, the capsule comprising:

a body shaped from a paper-based sheet to form a cavity wall and having an inner flange portion extending outwardly from the cavity wall, wherein the paper-based sheet comprises at least one oxygen barrier layer;

a predetermined dose of beverage ingredients contained within the body;

a cover configured for closing the body, wherein the cover is a paper-containing sheet and comprises a gas barrier layer, and wherein the cover is designed for perforation by the beverage preparation device for injection of extracting liquid into the body and for removal of liquid beverage extract through outlets formed via perforation of the cover; and a flange configured for the cover to seal thereon, wherein the flange comprises an outer flange portion formed of molded polymer-based material, the outer flange portion comprising an annular recess forming an indentation in which the inner flange portion of the body is received, and the polymer-based material of the outer flange portion sealing at least partially against a lower surface of the inner flange portion oriented in a direction towards the cavity wall and against an outer edge of the inner flange portion, wherein the flange comprises a relief that is thicker than the rest of the flange and which protrudes in a direction opposite to the direction;

wherein the cover is sealed directly onto the flange to create a gas barrier seal for the capsule, the gas barrier seal configured to provide a substantially gas tight arrangement for the capsule; and wherein a lower part of the annular recess covers and contacts a portion of the lower surface of the inner flange portion, and wherein an upper part of the annular recess covers and contacts a portion of an upper surface of the inner flange portion.

2. The capsule of claim 1, wherein the cavity wall is revolutionary symmetrical.

3. The capsule of claim 1, wherein the outer flange portion prolongs the flange from the outer edge of the inner flange portion both in an outwardly radial direction ($R_E$) and in an axial direction (C).

4. The capsule of claim 1, wherein the outer flange portion extends outwardly and radially beyond the inner flange portion of the body, and wherein a region of the outer flange portion extending outwardly and radially beyond the inner flange portion is thicker than a lower part of the outer flange portion sealing against a lower surface of the inner flange portion.

5. The capsule of claim 1, wherein the outer flange portion comprises an edge portion that is thicker than the rest of the flange, and wherein the edge portion has an axial dimension (L) longer than an axial dimension (Lo) of the outer flange portion.

6. The capsule of claim 1, wherein the paper-based sheet of the body comprises at least one sealing layer oriented towards a cavity defined by the cavity wall.

7. The capsule of claim 1, wherein the polymer-based material for the outer flange portion is an injection-moldable thermoplastic material or elastomeric-thermoplastic material (TPE) selected from a group consisting of polyethylene (PE), high-density polyethylene (HDPE), polypropylene, polyethylene terephthalate (PET) and combinations thereof.

8. The capsule of claim 1, wherein the molded polymer-based material is filled with reinforcing material.

9. The capsule of claim 1, wherein the outer flange portion comprises an identification code.

10. The capsule of claim 9, wherein the identification code is an optically readable barcode.

11. The capsule of claim 1, wherein the predetermined dose of beverage ingredients is selected from the group consisting of ground coffee, soluble coffee, coffee beans, leaf tea, soluble tea, dairy products, cocoa, chicory, barley, culinary aid, soup ingredient, infant formula and combinations thereof.

12. The capsule of claim 1, wherein the paper-based sheet comprises at least 50% in weight of cellulose.

13. The capsule of claim 1, wherein the paper-containing sheet comprises less than 50% in weight of cellulose.

14. A capsule configured for preparation of a beverage in a beverage preparation device, the capsule comprising:

a body shaped from a paper-based sheet to form a cavity wall containing beverage ingredients and an inner flange portion extending outwardly from the cavity wall;

a cover configured for closing the body;

a flange configured for the cover to seal thereon, wherein the flange comprises an outer flange portion formed of moulded polymer-based material comprising a recess configured to receive the inner flange portion, and the moulded polymer-based material of the outer flange portion sealing at least partially against a lower surface of the inner flange portion oriented in a direction towards the cavity wall and against an outer edge of the inner flange portion; and wherein a lower part of the recess covers and contacts a portion of the lower surface of the inner flange portion, and wherein an upper part of the recess covers and contacts a portion of an upper surface of the inner flange portion.

15. The capsule of claim 14, wherein the paper-based sheet comprises at least 50% in weight of cellulose.

16. The capsule of claim 14, wherein the cavity wall is revolutionary symmetrical, and the recess is annular.

17. The capsule according to claim 14, wherein the cover is a paper-containing sheet comprising less than 50% in weight of cellulose.

* * * * *